US012065770B2

(12) United States Patent
Roeleveld et al.

(10) Patent No.: US 12,065,770 B2
(45) Date of Patent: Aug. 20, 2024

(54) FLAT KNIT BRA

(71) Applicant: SOFT REVOLT TECH B.V, Amstelveen (NL)

(72) Inventors: Elisabeth Gabrielle Roeleveld, Amstelveen (NL); Cherish Brouwer, Diemen (NL)

(73) Assignee: Soft Revolt Tech B.V., Amstelveen (NL)

( * ) Notice: Subject to any disclaimer, the term of this patent is extended or adjusted under 35 U.S.C. 154(b) by 36 days.

(21) Appl. No.: 18/011,366

(22) PCT Filed: Jul. 1, 2021

(86) PCT No.: PCT/EP2021/068140
§ 371 (c)(1),
(2) Date: Dec. 19, 2022

(87) PCT Pub. No.: WO2022/003090
PCT Pub. Date: Jan. 6, 2022

(65) Prior Publication Data

US 2023/0232912 A1 Jul. 27, 2023

(30) Foreign Application Priority Data

Jul. 3, 2020 (NL) ..... 2026003

(51) Int. Cl.
*D04B 7/30* (2006.01)
*A41C 3/00* (2006.01)

(52) U.S. Cl.
CPC ..... *D04B 7/30* (2013.01); *A41C 3/0014* (2013.01); *D10B 2501/02* (2013.01)

(58) Field of Classification Search
CPC ... D04B 7/30; D04B 7/32; D04B 7/28; D04B 1/246; A41C 3/0021; A41C 3/0014
See application file for complete search history.

(56) References Cited

U.S. PATENT DOCUMENTS 5,138,849 A 8/1992 Stoll et al.
5,918,483 A 7/1999 Schmid et al.
6,685,534 B2 * 2/2004 Mitchell ..... D04B 1/24 450/74

(Continued)

FOREIGN PATENT DOCUMENTS

WO 2020169417 A1 8/2020

OTHER PUBLICATIONS

International Search Report and Written Opinion for PCT/EP2021/068140; Sep. 10, 2021; 10 pgs.

*Primary Examiner* — Danny Worrell
(74) *Attorney, Agent, or Firm* — Perilla Knox & Hildebrandt LLP

(57) ABSTRACT

The invention is directed to a flat knit bra comprising two cups (1*a*, 1*b*), each cup provided with a neckline zone (2*a*, 2*b*), two power slings (4*a*, 4*b*) and two wing zones (5*a*, 5*b*) and a band (6) having a first and second end (6*a*, 6*b*). The neckline zones (2*a*, 2*b*) may extend to the band (6) in an overlapping fashion. The power sling (4*a*, 4*b*) is comprised of a double layered knit material. The band (6) is branches from a common centre region (16) into more than one band zones (7,8,9,10). One band zone (7,8) extends to the ends (6*a*, 6*b*) of the band (6) and at least one other band zone (9,10) extends into each of the wings (5*a*, 5*b*).

18 Claims, 5 Drawing Sheets

(56) References Cited

U.S. PATENT DOCUMENTS

| | | | | |
|---|---|---|---|---|
| 7,614,256 | B2 * | 11/2009 | Mitchell | D04B 1/102 66/179 |
| 10,368,590 | B2 * | 8/2019 | Diaz | D04B 35/10 |
| 10,640,896 | B2 * | 5/2020 | Barnes | D04B 1/18 |
| 11,284,647 | B2 * | 3/2022 | Blecha | A41C 3/0021 |
| 11,684,092 | B2 * | 6/2023 | Roddis | A41C 3/0014 2/243.1 |
| 11,819,064 | B2 * | 11/2023 | Montgomery | D04B 1/246 |
| 2001/0037664 | A1 | 11/2001 | Haltenhof et al. | |
| 2016/0021940 | A1 | 1/2016 | Carney | |
| 2016/0242472 | A1 | 8/2016 | Turlan | |
| 2017/0119063 | A1 | 5/2017 | Diaz et al. | |
| 2017/0290376 | A1 | 10/2017 | Maheshwari et al. | |
| 2018/0317570 | A1 | 11/2018 | Diaz et al. | |
| 2018/0320297 | A1 | 11/2018 | Diaz et al. | |

* cited by examiner

Structure a.

Structure b.

Structure c.

Structure d.

Structure e.

Structure f′.

Structure f″.

Structure g.

FLAT KNIT BRA

FIELD OF THE INVENTION

The invention is directed to a flat knit bra comprising two cups (1*a*,1*b*), each cup provided with a neckline zone, with a power sling and with a wing. The bra further comprises a band.

BACKGROUND

Such a flat knit bra or flat bed knit bra is described in US2016/0242472. This publication describes a flat bed knitted bra which does not require a metal under wire. Most bras are provided with such a semi-circle metal wire positioned at the base of the cups to provide support and structure for the bra. Although it provides support and structure to the bra it does not add to the wearing comfort. Thus a knitted bra as the one described in this publication which does not require such a metal wire is desirable as it improves wearing comfort. The described flat bed knit bra has two cups which are transversely aligned via a bridge. This bridge is referred to in this publication as the stiffener and takes over the function of the metal underwire. This stiffener part runs from the bridge part between the cups to the wings at the outer ends of the cups and is knitted such that a low to almost null elastic extensibility in the vertical direction, i.e. along the length of the user, exists. Further the cups are made up of three (semi-)concentric regions are differently elastically extendable.

A problem of the flat knitted bra of US2016/0242472 is that they are less suited for larger breast sizes. The prior art bra will exert a pressure and compression on the breast resulting in that it flattens the curve.

US2017119063, US2018320297, US2017290376, and US2018317570 describe a flat bed knitted sports bra. Because of this use the breasts will be flattened or said otherwise: flattens the curve. This may be fine when using such a bra when performing sports or athletics, it is less desirable in normal use where the user may desire a bra which shapes the curve.

Knitted bras, like any other knitted product, have the advantage that the material is stretchy and thus fitting better on the body as compared to a woven material. A knitted bra may also be obtained by warp knitting and circular knitting. The advantage of flat bed knitting is that it can produce a knitted product with zero waste. Further flat bed knitting enables to create different material properties on different positions in the knitted bra which cannot be achieved by the two other knitting techniques.

SUMMARY

The present invention aims to provide a bra for daily use, especially suited for the larger cup sizes, which addresses one or more of the problems of the prior art bras.

This object is achieved with the following bra. Flat knit bra comprising two cups, two power slings and two wing zones and wherein the bra further comprises a band having a first and second end, wherein:

- the power sling is comprised of a double layered knit material, and
- the band is comprised of more than one band zones each zone comprised of a double layered knit material which band zones branch out from a common centre region below the cups such that at least one band zone extends to each of the first and second ends of the band and wherein at least one other band zone is extends into each of the wings.

Applicants found that the flat bed knitted bra according to this invention does not require a metal underwire and is suited for the larger cup sized breasts. Compared to the prior art bra the bra according to this invention may not require a bridge or stiffener between the cups. This allows larger breast sizes. The support required to leave out the metal underwire and a bridge is provided in the present bra by the combination of features as claimed. Further advantages will be described below.

DETAILED DESCRIPTION

Figure 1:
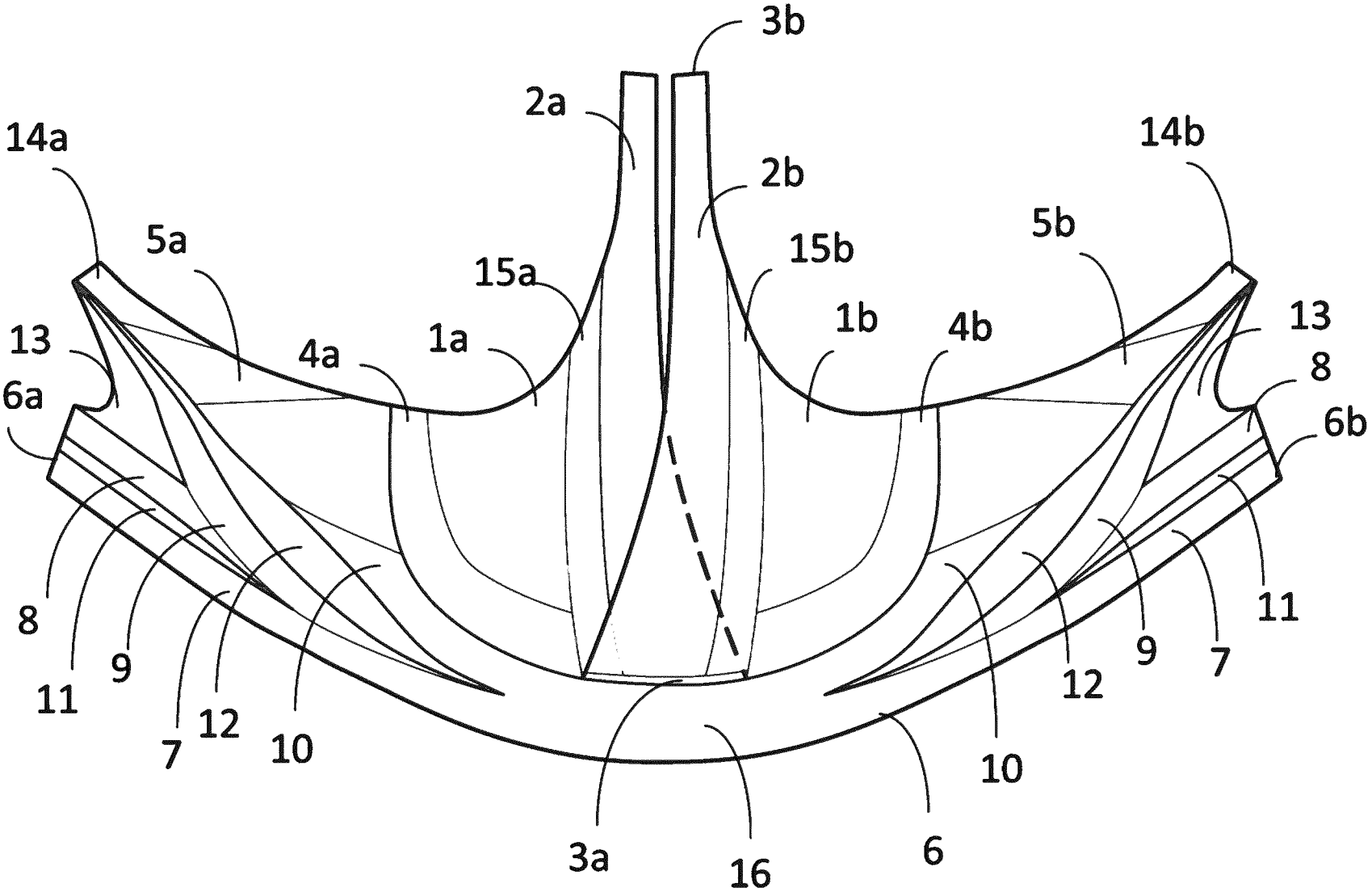
FIG. 1 shows a manufactured unitary flat knit bra without a closure and straps.

In this specification terms will be used which are known to the skilled person in bra technology. When terms like upper and lower are used it refers to a bra orientation of a wearer standing vertically. The terms upper and lower are used to more clearly describe the invention and is not meant to limit the invention to a bra in such an orientation. The cups are the two parts that cover the majority of the breasts. The neckline zone is the area along the front of the bra down the chest of the wearer. This area covers entirely or partly the upper end and centre of the breasts and is connected to the cups. The power sling is located at the outer sides of the cups running mainly in a vertical direction and provide lift and support to the breast. The power sling may cover the lower outer sides of the breasts. The wings are the surface parts which run from the power sling around the torso of the wearer. The wings are bounded at their upper end by a so-called under-arm and bounded at their lower end by the band. From an outer end of the wing to the upper end of the neckline a strap may be present. The band, sometimes also referred to as anchoring chest band, is the most lower part of the bra. The band will have at least two ends which in use will be connected by suitably a closure, for example hooks which may link into eyes, to close up the bra at the so-called center back.

The flat knit bra may have a bridge between the cups. The bridge is suitably flat on the body of the user and depending on its size determine the placement of the breasts. The bridge will extend from the band upwards at the common centre region. Each cup is provided with a neckline zone having a first and second end. The first end of the neckline zone of each cup may extend to the band such that one neckline zone partly overlaps the other neckline zone. This latter design does not have a bridge.

The flat knit bra is suitably a unitary product manufactured by an automated, flat-bed knitting machine, such as a v-bed machine with a front and back set of needles and a carriage that reciprocates back and forth. Examples of such machines are described in US2001037664, U.S. Pat. Nos. 5,918,483 and 5,138,849. The unitary product may include the straps and a closure. The closure may be added separately to the flat knit bra using other connection methods than the flat bed knitting, such as sewing. The first and second ends of the band of the flat knit bra may thus be provided with a fastener such as for example the well-known hooks and eyes. The straps may be part of the unitary flat knit bra product or may be added separately. The second end of each neckline zone may thus be connected to one of the wings, e.g. the outer end of the wing, by means of a, preferably in length adjustable, strap.

The bra consists of multiple types of knit structures, which are knitted on a flat bed knitting machine. At a high level, this disclosure describes a flat knit bra having various elements that contribute to the operation of the bra, both independently of, and in combination with, one another. The different parts of the bra have different knit structures. Other elements may also affect the properties of the bra, including (but not limited to) the yarn composition, yarn elasticity and yarn size, additional knit structures, and stitch size, which will be described in more detail in other parts of this disclosure.

The band is comprised of more than one band zones each zone comprised of a double layered knit material which band zones branch out from a common centre region below the cups. The use of the double layered knit material results in a strong band which has a limited stretch. The lower positioned band zone or zones may extend to each of the first and second ends of the band at which end a closure may be present. When closed a good fit and support of the bra will be achieved. The at least one other band zone extends into each of the wings and preferably to the outer end of the wing where a strap may be connected. This results in that a further support is achieved running from the common centre region of the band to the strap.

Suitably at least two parallel oriented band zones, preferably two parallel oriented band zones, extend to each of the of the first and second ends of the band. It has been found that when these at least two parallel oriented band zones are connected to each other by a single layered knit material a band region is created which has a limited stretch in the horizontal direction around the torso of the wearer and some elasticity in the vertical direction especially at the back of the torso when used which results in a more comfortable to wear bra.

Suitably at least two parallel extending band zones, preferably two parallel extending band zones, extend into each of the wings. Suitably these band zones extend up to the outer end of the wing where a strap may be connected. It has been found that when these at least two parallel oriented band zones are connected to each other by a single layered knit material a wing is created which has a limited stretch in the horizontal direction around the torso of the wearer and some elasticity in the vertical direction especially at the back of the torso when used which results in a more comfortable to wear bra.

The above described one of the al least one band zones extending to each of the first and second ends of the band and one of the at least one band zones extending into each of the wings are suitably connected by a single knit layered material. This part is suitably at the back of the torso when used which enhances the wearability of the bra by avoiding skin pressure points.

The single knit material used to connect the band zones as described above is suitably comprised of a single bedded knit with transfer stitches to the back and front with two-sided racking combined with diametrical reversed transfer. The yarns used for this single knit material may have a high elasticity.

The double layered knit material of the band zones may suitably have a three layered structural binding with a six row rapport consisting of a first and second row of repetitive staggered single front bedded knitted loops and floats, a third row of repetitive double bedded tucked loops, a fourth and fifth row of diapositive to the first and second row repetitive staggered back bedded knitted loops and floats and a sixth row of diapositive to the third row of repetitive double bedded tucked loops. The yarns used for the double layered knit material may have a low elasticity and suitably lower that the yarns used for the above described single knit material.

The power sling may be connected at one side to the cup and at its other side to the most upper positioned band zone which extends into the wing. The elasticity of the power sling may be higher than the elasticity of this neighbouring band zone. The transition of the double layered knit material of the band zone to the power sling may be such that the elasticity is gradually increased. This may be achieved by a combination of stitches and by varying the amount of yarn material used in the bindings. A binding comprises a combination of more than one stitches. Preferably the power sling is comprised of double layered knit material which has a higher elasticity at a position near to the cup as compared to the elasticity of the material at a position further away from the cup. This enhances the wearability of the bra.

The double layered knit material of the power sling may be comprised of a three layered structural binding with a six row rapport consisting of one row of repetitive staggered single front bedded knitted loops and floats, two rows of repetitive staggered single back bedded knitted loops and floats, two rows of repetitive double bedded tucked loops diapositive positioned towards each other and one row of repetitive staggered single front bedded knitted loops and floats.

The end of the neckline zone of each cup extends to the band such that one neckline zone partly overlaps the other neckline zone. Either the left (for the wearer) neckline zone may overlap the right neckline zone or the other way around. The neckline zone is comprised of a single layer knit material obtained by and every other needle knitting method. This is advantageous because it results in a light material having still enough strength required to provide the necessary support in this region of the bra.

The single layer knit material of the neck line zone may be a single bedded knit having four rows with transfer stitches to a back and front side of the material and with two-sided racking combined with diametrical reversed transfer and wherein the needle sequence is a combination of knitted loops and floats thus creating a pseudo every other needle knitted structure and wherein the first two rows of the four rows are a geometrical sequence of loops and extended floats and wherein the third and fourth row of the four rows are a geometrical sequence of transferred loops to the back side and reversed transferred in combination with diametrical reversed racking on the back bed of the flat bed knitting machine.

The cups are shaped by means of short row knitting and by a combination of stitches and different stitch length as described below. Having a shaped cup further enhances the comfort when wearing the bra according to this invention. The cups are further suitably comprised two connected single layered knit materials. This allows one to use different yarns, for example for the exterior layer one can use yarns having a nice appearance and for the inner layer which covers the breasts one may use yarns which are more comfortable for skin contact.

The two connected single layered knit materials suitably comprise of a double bedded structure of a first and second row with a binding of a geometrical sequence of front and back bedded loops and floats, wherein the first row has an interconnected front and back bedded loop in a repetitive sequence with extended floats and wherein the second row has an interconnected front and back bedded loop in a repetitive sequence with extended floats in an obverse geometrical sequence towards the first row.

The yarns used to to make the unitary flat knit bra may be any elastic yarn, such as an elastane yarn. The elastic yarn is suitably covered by a non-elastic yarn such as a polyamide, like for example Nylon 6.6 or Nylon 6.

To enhance the rigidity of certain parts of the unitary flat knit bra it is preferred to additionally use a thermal molded fiber when knitting these certain parts next to the earlier referred to yarns. An example of such a thermal molded fiber is a thermoplastic polyurethane fiber as for example described in WO2020/169417. The parts which preferably comprise of these thermal molded fibers are the more than one band zones at the common centre region at the cups. Preferably also the straps comprise of the thermal molded fiber and more preferably the half of the straps closest to the neckline. The content of thermal molded fiber as comprised in the flat knit bra is preferably between 5 and 15 wt % on the total of yarns of the bra. The content may vary depending on the shape and size of the flat knit bra, wherein a higher sizes bra suitably comprises more of the thermal molded fiber.

The intermediate flat knit bra product as it is manufactured by a flat bed knitting machine and having parts which comprise the thermal molded fiber is preferably subjected to a thermal treatment. This thermal treatment is suitably a steaming or ironing treatment. The required temperature will depend on the type of thermal molded fiber. For example a steaming process at about 130 C and a pressure of 2 bars may be sufficient for obtaining the desired product when using typical yarns.

The invention shall be illustrated by the following FIGS. 1-9.

FIG. 1 shows a manufactured unitary flat knit bra without a closure and straps. These may be added separately. This figure shows a flat knit bra having two cups (1*a*,1*b*), each cup provided with a neckline zone (2*a*,2*b*) having a first and second end (3*a*,3*b*). Neighbouring a cup (1*a*,1*b*) a power sling (4*a*,4*b*) is shown. Further each end of the bra is provided with a wing zone (5*a*,5*b*). As the lowest part of the bra a band (6) is shown having a first and second end (6*a*,6*b*). The first end (3*a*) of the neckline zone (2*a*,2*b*) of each cup extends to a centre region (16) of the band (6) such that the left neckline zone (2*b*) partly overlaps the other neckline zone (2*a*).

The band is comprised of four band zones (7,8,9,10) extending to both ends of the bra. The four band zones (7,8,9,10) branch out from a common centre region (16) of the band just below the cups (1*a*,1*b*). Band zones (7,8) extends to each of the first and second ends (6*a*,6*b*) of the band (6). The two band zones (9,10) extends into each of the wings (5*a*,5*b*). The two parallel oriented band zones (7,8) are connected to each other by a single layered knit material (11). The two parallel oriented band zones (9,10) are connected to each other by a single layered knit material (12). Band zone (8) extending to the first and second ends (6*a*,6*b*) of the band (6) are connected to band zone (9) extending into each of the wings (5*a*,5*b*) by a single knit layered material (13). Band zone (9) and band zone (10) extend into the wing (5*a*,5*b*) up to the outer end of the wing (14*a*,14*b*).

The cups (1*a*,1*b*) are provided with a cup subsection (15*a*,15*b*) which is a zone which neighbours with the neckline zone (2*a*,2*b*) respectively. This zone may have a somewhat tighter stitch construction resulting in that the nipple can be effectively covered.

Figure 2:
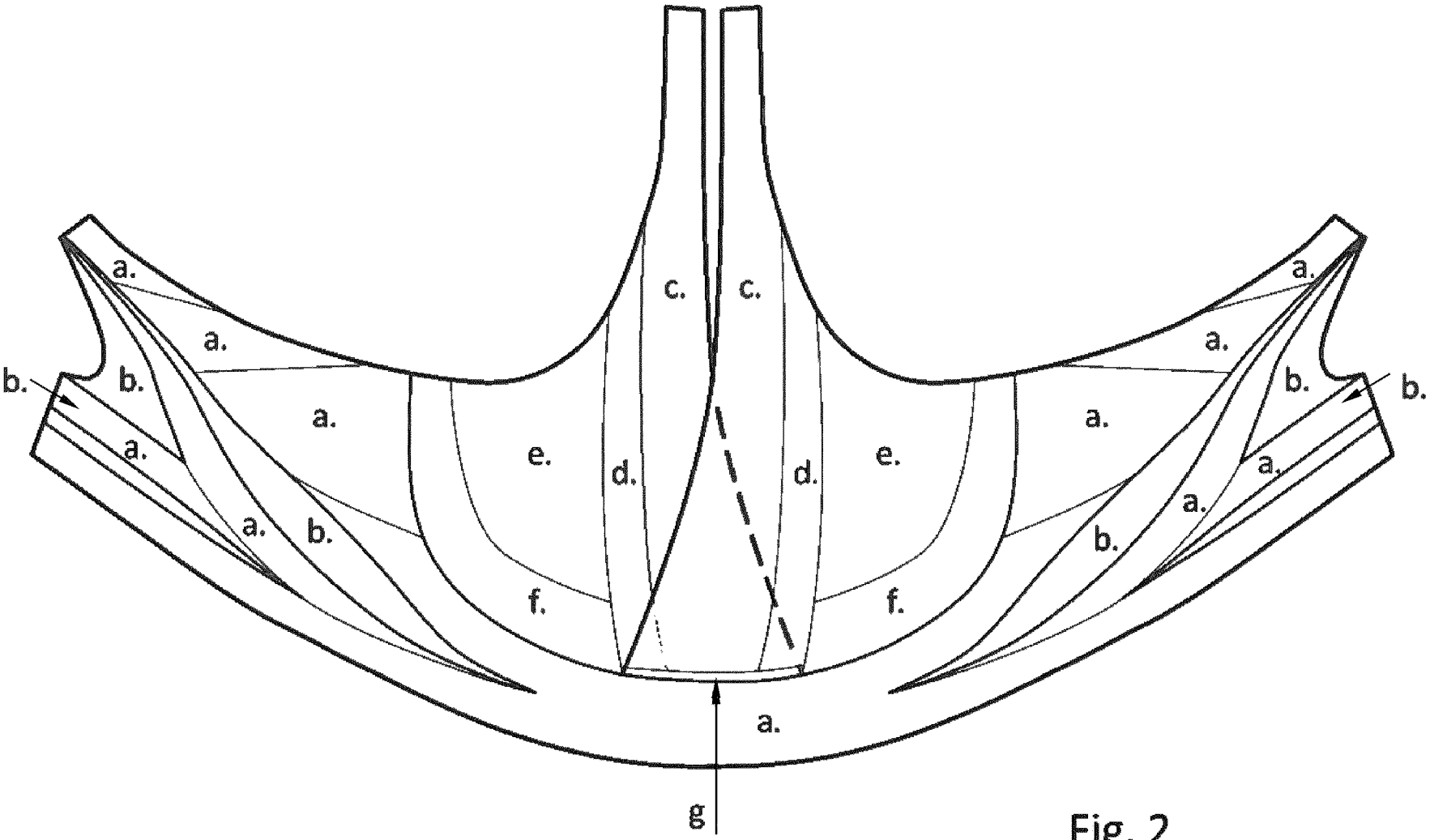
FIG. 2 shows the bra of FIG. 1 wherein each part of the bra is provided with a reference to a preferred stitch construction used for the different parts described in FIG. 1.

FIG. 2 shows the bra of FIG. 1 wherein each part of the bra is provided with a reference to a preferred stitch construction used for the different parts described in FIG. 1. Each stitch construction, apart from stitch construction (c), consists of a combination of single bedded and/or double bedded, interloped knitted stitches, or single bedded, double bedded interloped knitted stitches. All knitted constructions use their combination of yarn types, loops, stitch length, tension and interconnectivity to create different types of structures for their specific elastic behaviour. The knitted structures are created to achieve a specific linear elasticity which is needed for the support in a bra for larger sized breasts. In some cases the material's elastic modulus differs when force is applied in other directions, this is required for the optimal comfort the bra achieves by not straining any part of the body too much or too little so that it lacks the needed support.

Figure 2A:
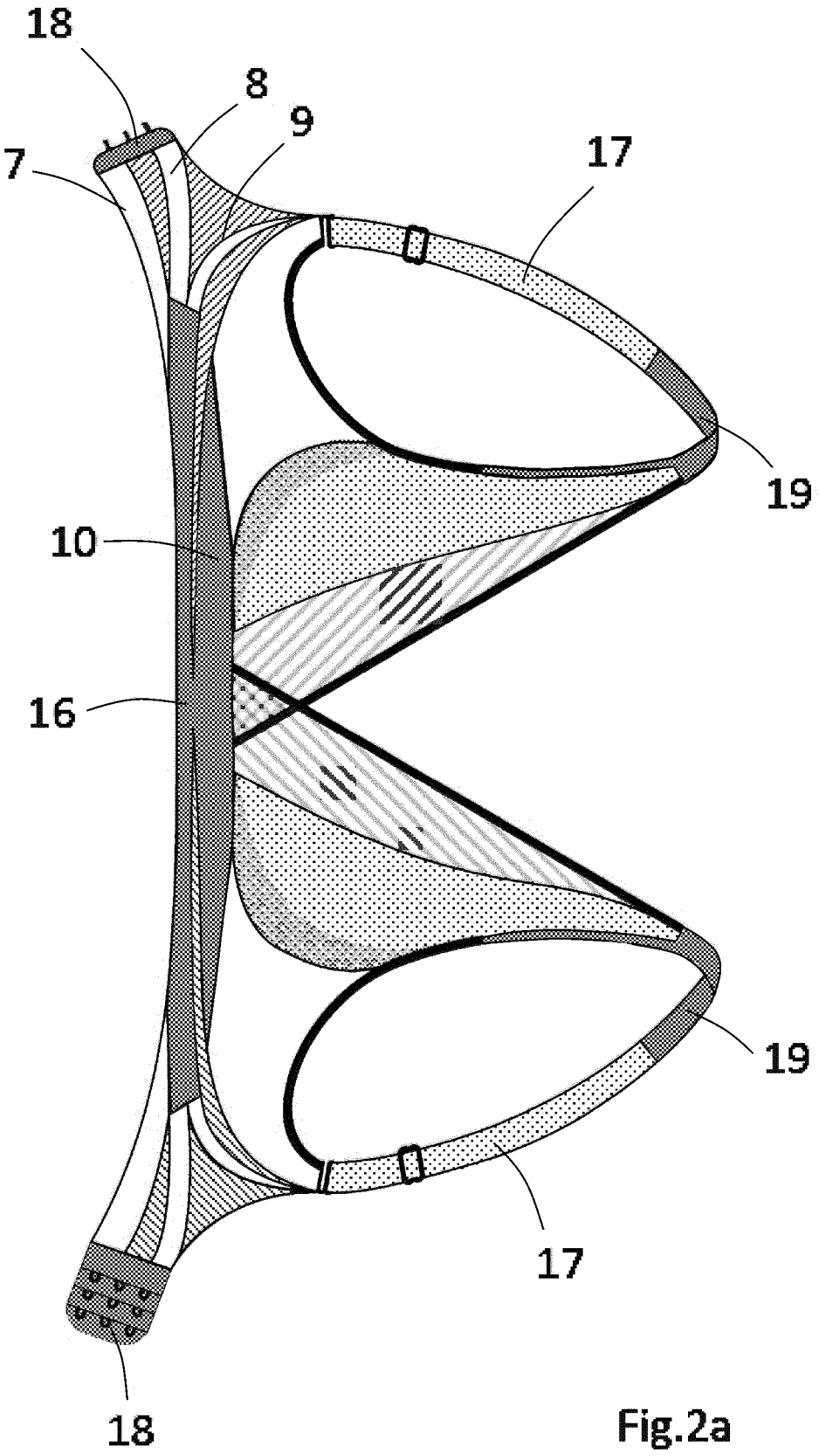
FIG. 2*a* shows a bra of FIGS. 1 and 2 provided with a closure and straps.

FIG. 2*a* shows a bra of FIGS. 1 and 2 provided with a closure (18) and straps (17). The dark coloured part of the band zones (7,8,9,10) at the common centre region (16) is provided with a thermal molded fiber. The dark coloured part (19) of the straps (17) are also provided with a thermal molded fiber. The straps (17) are part of the manufactured unitary flat knit bra.

Figure 3:
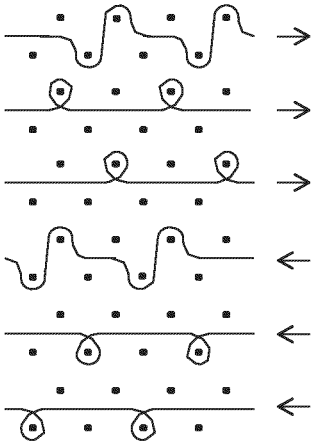
FIG. 3 shows stitch construction having a three layered structural binding with a six row rapport consisting of a first and second row of repetitive staggered single front bedded knitted loops and floats, one third row of repetitive double bedded tucked loops, a fourth and fifth row of diapositive to the first and second row repetitive staggered back bedded knitted loops and floats and a sixth row of diapositive to the third row of repetitive double bedded tucked loops.

FIG. 3 shows stitch construction (a) having a three layered structural binding with a six row rapport consisting of a first and second row of repetitive staggered single front bedded knitted loops and floats, one third row of repetitive double bedded tucked loops, a fourth and fifth row of diapositive to the first and second row repetitive staggered back bedded knitted loops and floats and a sixth row of diapositive to the third row of repetitive double bedded tucked loops.

Figure 4:
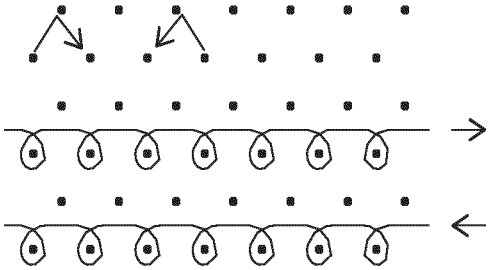
FIG. 4 shows stitch construction for a single bedded knit with transfer stitches to the back and front with two-sided racking combined with diametrical reversed transfer.

FIG. 4 shows stitch construction (b) for a single bedded knit with transfer stitches to the back and front with two-sided racking combined with diametrical reversed transfer.

Figure 5:
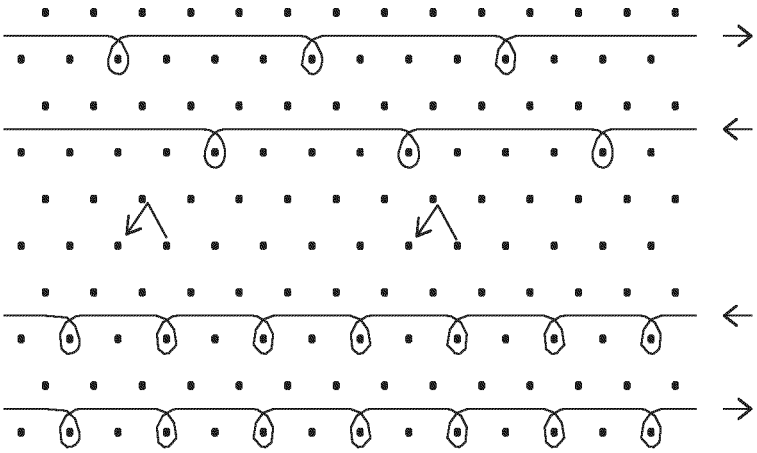
FIG. 5 shows stitch construction for a single bedded knit having four rows with transfer stitches to a back and front side of the material and with two-sided racking combined with diametrical reversed transfer and wherein the needle sequence is a combination of knitted loops and floats thus creating a pseudo every other needle knitted structure and wherein the first two rows of the four rows are a geometrical sequence of loops and extended floats and wherein the third and fourth row of the four rows are a geometrical sequence of transferred loops to the back side and reversed transferred in combination with diametrical reversed racking on the back bed of the flat bed knitting machine.

FIG. 5 shows stitch construction (c) for a single bedded knit having four rows with transfer stitches to a back and front side of the material and with two-sided racking combined with diametrical reversed transfer and wherein the needle sequence is a combination of knitted loops and floats thus creating a pseudo every other needle knitted structure and wherein the first two rows of the four rows are a geometrical sequence of loops and extended floats and wherein the third and fourth row of the four rows are a geometrical sequence of transferred loops to the back side and reversed transferred in combination with diametrical reversed racking on the back bed of the flat bed knitting machine.

Figure 6:
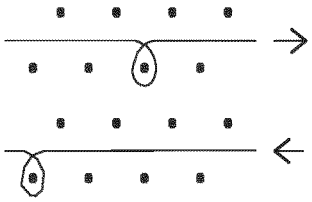
FIG. 6 shows stitch construction as a transitional structure with an obverse geometrical sequence of loops and floats.

FIG. 6 shows stitch construction (d) as a transitional structure with an obverse geometrical sequence of loops and floats.

Figure 7:
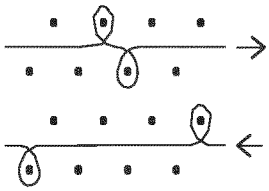
FIG. 7 shows stitch construction as a double bedded structure of a first and second row with a binding of a geometrical sequence of front and back bedded loops and floats, wherein the first row has an interconnected front and back bedded loop in a repetitive sequence with extended floats and wherein the second row has an interconnected front and back bedded loop in a repetitive sequence with extended floats in an obverse geometrical sequence towards the first row.

FIG. 7 shows stitch construction (e) as a double bedded structure of a first and second row with a binding of a geometrical sequence of front and back bedded loops and floats, wherein the first row has an interconnected front and back bedded loop in a repetitive sequence with extended floats and wherein the second row has an interconnected front and back bedded loop in a repetitive sequence with extended floats in an obverse geometrical sequence towards the first row.

Figure 8A:
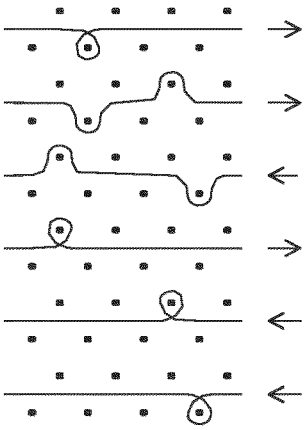
FIG. 8*a* shows stitch construction as a three layered structural binding with a six row rapport consisting of one row of repetitive staggered single front bedded knitted loops and floats, two rows of repetitive staggered single back bedded knitted loops and floats, two rows of repetitive double bedded tucked loops diapositive positioned towards each other and one row of repetitive staggered single front bedded knitted loops and floats.

FIG. 8*a* shows stitch construction (f') as a three layered structural binding with a six row rapport consisting of one row of repetitive staggered single front bedded knitted loops and floats, two rows of repetitive staggered single back bedded knitted loops and floats, two rows of repetitive double bedded tucked loops diapositive positioned towards each other and one row of repetitive staggered single front bedded knitted loops and floats.

Figure 8B:
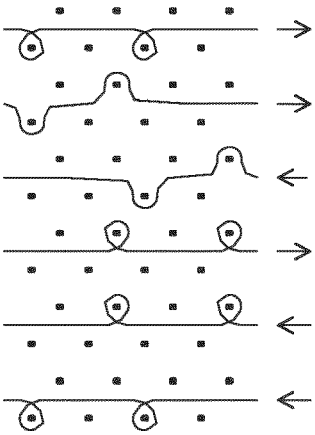
FIG. 8*b* shows an alternative for stitch construction having less elasticity and is more densely knit.

FIG. 8*b* shows an alternative for stitch construction (f") having less elasticity and is more densely knit.

Figure 9:
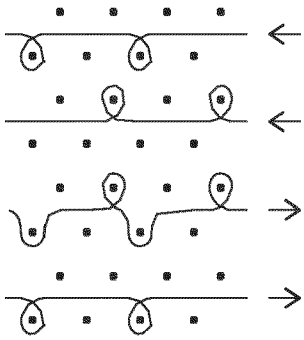
FIG. 9 shows stitch construction for the overlap and connection of the neckline with the band.

FIG. 9 shows stitch construction (g) for the overlap and connection of the neckline with the band.

The invention claimed is:

1. A flat knit bra comprising:

two cups, two power slings, each power sling being located at an outer side of a respective one of the two cups, and two wing zones, each wing zone extending from a respective one of the two power slings and configured to extend around a torso of a wearer when worn, and wherein the bra further comprises a band having a first and second end, wherein:

the power sling is comprised of a double layered knit material, and the band is comprised of more than one band zones each zone comprised of a double layered knit material, which band zones branch out from a common centre region at the cups such that at least one band zone extends to each of the first and second ends of the band and wherein at least one other band zone extends into each of the wings.

2. The flat knit bra according to claim 1, wherein each cup is provided with a neck line zone having a first and second end and wherein the first end of the neck line zone of each cup extends to the band such that one neck line zone partly overlaps the other neck line zone.

3. The flat knit bra according to claim 1, wherein at least two parallel oriented band zones extend to each of the of the first and second ends of the band.

4. The flat knit bra according to claim 3, wherein the at least two parallel oriented band zones are connected to each other by a single layered knit material.

5. The flat knit bra according to claim 1, wherein at least two parallel extending band zones extend into each of the wings.

6. The flat knit bra according to claim 5, wherein the at least two parallel oriented band zones are connected to each other by a single layered knit material.

7. The flat knit bra according to claim 1, wherein one of the at least one band zones extending to each of the first and second ends of the band and one of the at least one band zones extending into each of the wings are connected by a single knit layered material.

8. The flat knit bra according to claim 1, wherein the power sling is comprised of double layered knit material which has a higher elasticity at a position near to the cup as compared to the elasticity of the material at a position further away from the cup.

9. The flat knit bra according to claim 1, wherein the neck line zone is comprised of a single layer knit material obtained by an every other needle knitting method.

10. The flat knit bra according to claim 1, wherein the cups are shaped by means of short row knitting.

11. The flat knit bra according to claim 10, wherein the cups comprise two connected single layered knit materials.

12. The flat knit bra according to claim 1, wherein the double layered knit material of the more than one band zones is comprised of an elastane yarn covered by a polyamide yarn.

13. The flat knit bra according to claim 12, wherein the double layered knit material of the more than one band zones at the common centre region at the cups further comprise of a thermal molded fiber.

14. The flat knit bra according to claim 13, wherein the thermal molded fibre is a thermoplastic polyurethane fiber.

15. The flat knit bra according to claim 13, comprising between 5 and 15 wt % of the thermal molded fiber.

16. The flat knit bra according to claim 13, wherein the thermal molded fiber is obtained by steaming the double layered knit material.

17. The flat knit bra according to claim 1, wherein the first and second ends of the band are provided with a fastener.

18. The flat knit bra according to claim 1, wherein the second end of each neck line zone is connected to one of the wings by means of a strap.

* * * * *